US009597603B1

(12) United States Patent
Fisher

(10) Patent No.: US 9,597,603 B1
(45) Date of Patent: Mar. 21, 2017

(54) LINEAR INDUCTION MOTOR USE WITH WATERSLIDE RAFT ON NON RIDING SURFACES

(71) Applicant: Skyturtle Technologies Ltd., Enderby (CA)

(72) Inventor: Lance C Fisher, Enderby (CA)

(73) Assignee: Skyturtle Technologies Ltd, Enderby (CA)

( * ) Notice: Subject to any disclaimer, the term of this patent is extended or adjusted under 35 U.S.C. 154(b) by 0 days.

(21) Appl. No.: 14/958,755

(22) Filed: Dec. 3, 2015

Related U.S. Application Data

(60) Provisional application No. 62/087,170, filed on Dec. 3, 2014.

(51) Int. Cl.
*A63G 21/18* (2006.01)
*A63G 21/00* (2006.01)

(52) U.S. Cl.
CPC ..... *A63G 21/18* (2013.01)

(58) Field of Classification Search
CPC . A63G 1/00; A63G 7/00; A63G 21/00; B61B 5/00
USPC ..... 472/117, 128, 129, 13; 104/53, 59, 23.1, 104/23.2, 72, 73
See application file for complete search history.

(56) References Cited

U.S. PATENT DOCUMENTS

| | | | | |
|---|---|---|---|---|
| 3,585,939 | A * | 6/1971 | Laithwaite | B60L 13/03 104/23.2 |
| 3,667,398 | A * | 6/1972 | English | H02K 41/025 104/290 |
| 5,860,364 | A | 1/1999 | McKoy | |
| 6,237,499 | B1 * | 5/2001 | McKoy | A63G 33/00 104/292 |
| 8,136,453 | B2 | 3/2012 | Hunter et al. | |
| 8,162,769 | B2 | 4/2012 | Henry | |
| 2007/0201869 | A1 * | 8/2007 | Weston-Dawkes | H04J 14/0284 398/45 |

FOREIGN PATENT DOCUMENTS

| | | | |
|---|---|---|---|
| CA | 2654714 | A1 | 3/2002 |
| WO | 2014121395 | A1 | 8/2014 |

* cited by examiner

*Primary Examiner* — Kien Nguyen
(74) *Attorney, Agent, or Firm* — Schacht Law Office, Inc.; Dwayne Rogge

(57) ABSTRACT

The present disclosure provides an amusement ride comprising in one example a linear induction motor (LIM) secondary that is recessed from the sliding surface of a raft. Sections of flume that contain the linear induction motor primaries may be raised up vertically above the lowermost inner surface to come in close contact with the recessed aluminum structure and to protect the LIM primaries from water damage and contact damage.

5 Claims, 2 Drawing Sheets

LINEAR INDUCTION MOTOR USE WITH WATERSLIDE RAFT ON NON RIDING SURFACES

RELATED APPLICATIONS

This application claims priority benefit of U.S. Provisional Patent Application Ser. No. 62/087,170, filed 2014 Dec. 3, incorporated herein by reference.

BACKGROUND OF THE DISCLOSURE

Field of the Disclosure

This disclosure relates to a waterslide vehicle that in one example uses a raised inner surface of the flume to support linear induction motors which apply force to the vehicle on a surface other than the primary sliding surface.

BRIEF SUMMARY OF THE DISCLOSURE

Disclosed herein is a waterslide amusement ride comprising: a flume having a lowermost inner surface having a lateral center; the flume having a vertically raised projection from the lowermost inner surface at the lateral center; a linear induction motor primary on an upper region of the raised projection; the linear induction motor primary vertically above the lowermost inner surface of the flume a vehicle longitudinally traversing the flume the vehicle having a linear induction motor secondary in a laterally central region thereof; the linear induction motor secondary positioned vertically above the linear induction motor primary when the vehicle is traversing above the vertically raised projection of the flume; the vehicle having a vehicle sliding surface on either lateral side of the vertically raised projection when the vehicle is traversing above the vertically raised projection of the flume.

The waterslide amusement as recited herein may be arranged wherein the frame is rigid/non inflatable.

The waterslide amusement herein may further comprise a backing plate positioned between the linear induction motor secondary and the linear induction motor primary when the vehicle is traversing above the vertically raised projection of the flume.

The waterslide amusement may be arranged wherein the vertically raised projection of the flume comprises a surface defining a downward extending slot into which extends the linear induction motor secondary.

The waterslide amusement may be arranged wherein the linear induction motor comprises a plurality of primaries, one on each lateral inner side of the slot.

DETAILED DESCRIPTION OF THE DISCLOSURE

Figure 1:
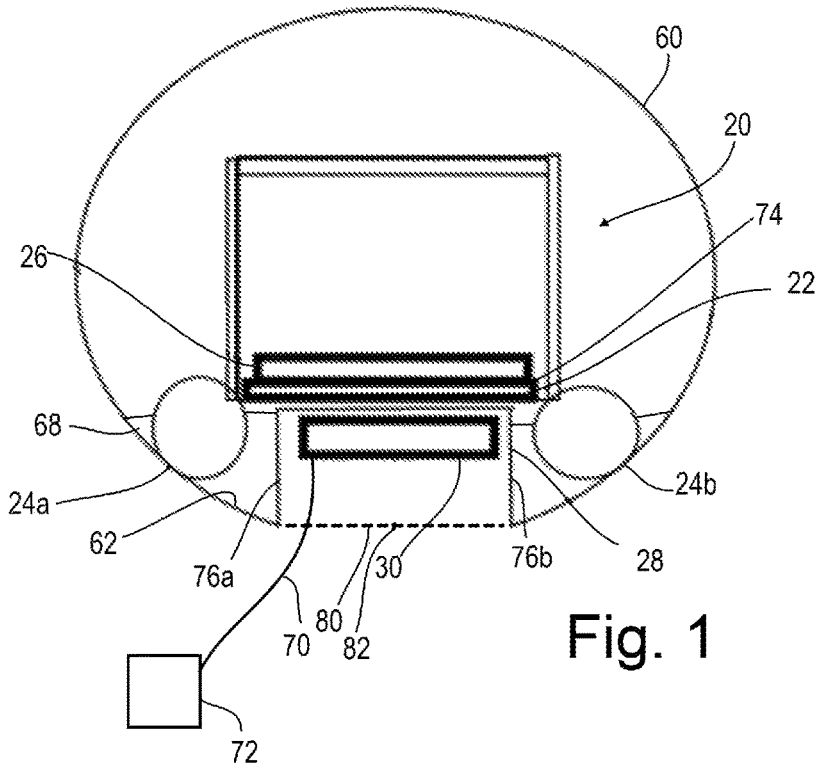
FIG. 1 is a rear view of one example of the disclosed vehicle inside a raised section of flume.

FIG. 1 shows a perspective rear view of one example of a vehicle (raft) 20 having a frame 22, vehicle sliding surfaces 24*a*-24*b*, linear induction motor (LIM) primary 30 with a secondary having a backing plate 26, and a raised flume section 28.

Figure 2:
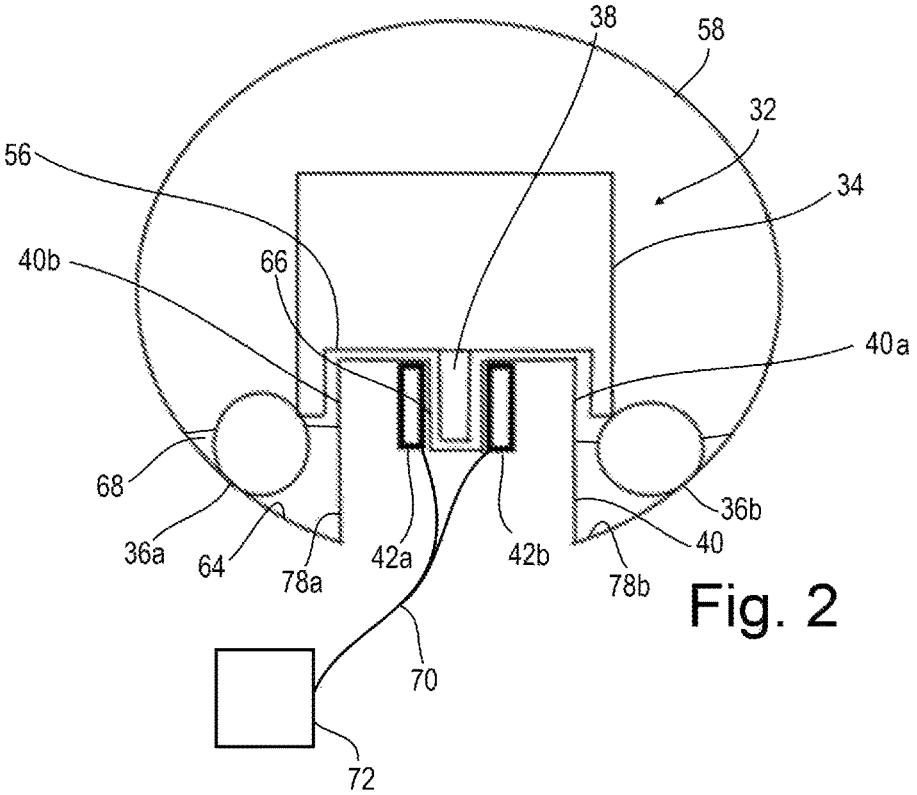
FIG. 2 is a rear view of another example of the disclosed vehicle inside a raised section of flume.

FIG. 2 shows a perspective back view of one example of another vehicle 32 having a frame 34, vehicle sliding surfaces 36*a*-36*b*, fin-shaped LIM secondary 38, raised flume section 40 and LIM primaries 42*a* and 42*b*.

Figure 3:
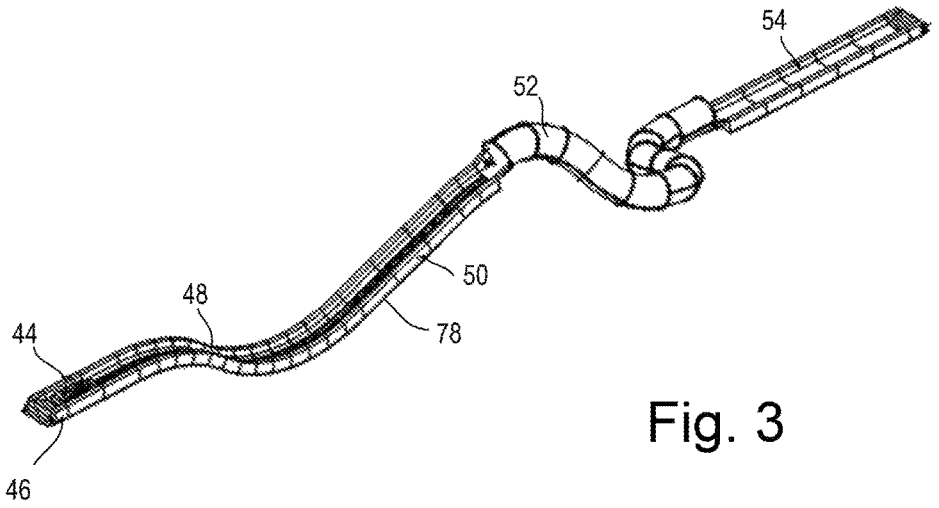
FIG. 3 is a perspective view of yet another example of the disclosed amusement ride.

FIG. 3 is a perspective isometric view of one example of the disclosed amusement ride with vehicle (raft) 44 (i.e. vehicle 20 or 32), entry section 46, raised flume sections 48 with LIMs 50 (i.e. 30 or 42), flume sections 52 without raised flume sections (i.e. 28 or 40), these flume sections 52 also without LIMs 50, and a run out (exit) section 54.

A single component or multiple component secondary (i.e. backing plate 26 or fin 38) may be integrated into the waterslide vehicle 44 (raft) to absorb magnetic force from LIM primaries 50 to move the vehicle 20/32/44 forward and/or to provide some magnetic lift to the vehicle 20/32/44. The secondaries 74/38 may be formed of aluminum or similar materials.

Disclosed herein is an amusement waterslide ride comprising in one example: a LIM secondary that is recessed vertically upward from a sliding surface of the vehicle 20/32/44.

It is also disclosed that sections of flume 58/60 that contain the linear induction motor primaries 30/42 are raised up above the lowermost inner surface 62/64 of the flume 60/58 to come in close contact with the recessed structure.

A LIM 50 is in one example an alternating current (AC) asynchronous linear motor that is designed to directly produce motion in a straight line. Characteristically, LIMs have a finite length primary or secondary, which generates end-effects. Lim's may also provide a levitation (lift) force.

LIMs are often used where contactless motive force is desired, where low maintenance is desirable, or where the duty cycle is low. Their practical uses include magnetic levitation, linear propulsion, and linear actuators. U.S. Pat. No. 782,312, 3,824,414 and 3,585,423 (incorporated herein by reference) disclose the principal of operation of such linear induction motors.

A linear electric motor's primary typically consists of a flat magnetic core (generally laminated (i.e. primary 30/42/50)). The primary often includes transverse slots which are often straight cut with coils laid into the slots, with each phase (of a multi-phase system) giving an alternating polarity so that the different phases physically overlap.

The secondary is frequently a sheet of aluminum (i.e. 74/38, often with an iron backing plate (i.e. backing plate 26). Some LIMs are double sided (i.e. fin 38), with one primary (i.e. LIM either side of the secondary, and in this case no iron backing is needed.

The amusement ride as disclosed in FIG. 2 may be arranged wherein a support plate 56 is recessed from the sliding surface 36*a*-36*b* into the structure (frame 22) of the vehicle 20.

Looking to the examples of FIG. 1 and FIG. 2, sections of the flume 48/58/60 that contain LIM primaries 30/42/50 may be positioned above the lowermost inner surface 62/64 of the flume 60/58. As the flume generally will contain at least some water 68, this raised section provides a region at least partially protected from the water 68. In addition, the raised flume sections 28/40 have side surfaces 76*a*-76*b*/78*a*-78*b* which may contact and horizontally align the sliding surfaces 24/36.

One example of the upper surface of the raised flume section 40 of the flume 58 as shown in FIG. 2 may contain a vertically downward recessed slot 66 for the plate (i.e. fin 38) to travel through.

In more detail, it can be seen that the example of FIG. 1 shows a perspective rear view of the vehicle (raft) 20 with vehicle sliding surfaces 24 which may be inflatable, foam filled, or otherwise provide floatation to the vehicle 20. A volume of water 68 is generally provided within the flume 60, and substantially more water 68 will be provided in the flume sections 52 which do not include LIM's. The flume 60 having a lowermost inner surface 80 having a lateral center 82.

The vehicle 20/32 furthermore often utilizing a rigid frame 22/34 to provide protection to riders within the vehicle 20/32, secure attachment an alignment of the LIM, and a rigid or semi rigid attachment for seats, harnesses, or other decorative, functional, and safety components. Other non-rigid (inflatable) rafts have been utilized in waterslide amusement rides.

The backing plate 26 may be attached to or formed as part of the frame 34. The backing plate 26 providing a receptor for magnetic fields produced when electric power is provided to the linear induction motor primary 30 by way of conduits 70 from a power source 72. The power source may be local such as batteries or a generator, or may be a municipal electric power source. As electric power is passed through the linear induction motor primaries 30/42, motive force is transferred to the vehicle 20/32 via secondaries 74/38 for forward movement of the vehicle. In FIG. 3 for example, LIM incorporated flume sections 48 may be utilized where an uphill flume region 78 is encountered by the vehicle. Thus, the LIM 50 produces forward movement of the vehicle 44 in regions of low water flow, or uphill.

FIG. 2 shows a perspective back view of one example of another vehicle 32. This vehicle 32 also has a frame 34 which may be rigid, semi-rigid, vehicle sliding surfaces 36*a*-36*b*, fin 38, raised flume section 40 and linear induction motors 42*a* and 42*b*.

FIG. 3 is a perspective isometric view of one example of the disclosed amusement ride with vehicle (raft) 44 (i.e. vehicle 20 or 32), entry section 46, raised flume sections 48 with linear induction motors 50 (i.e. 30 or 42), flume sections 52 without raised flume sections (i.e. 28 or 40), these flume sections 52 also without linear induction motors 50, and a run out (exit) section 54.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

The invention claimed is:

1. A waterslide amusement ride comprising:

a. a flume having a lowermost inner surface having a lateral center;

b. the flume having a vertically raised projection from the lowermost inner surface at the lateral center;

c. a linear induction motor primary on an upper region of the raised projection;

d. the linear induction motor primary vertically above the lowermost inner surface of the flume;

e. a vehicle longitudinally traversing the flume supported by a primary contact surface;

f. the vehicle having a linear induction motor secondary in a laterally central region thereof;

g. the linear induction motor secondary positioned vertically above the linear induction motor primary when the vehicle is traversing above the vertically raised projection of the flume; and h. the vehicle having a flume primary contact surface on either lateral side of the vertically raised projection when the vehicle is traversing above the vertically raised projection of the flume wherein the linear induction motor applies force to the vehicle at a surface other than the primary contact surface.

2. The waterslide amusement as recited in claim 1 wherein the linear induction motor is attached to a frame of the vehicle; wherein the frame is rigid.

3. The waterslide amusement as recited in claim 1 further comprising a backing plate positioned between the linear induction motor secondary and the linear induction motor primary when the vehicle is traversing above the vertically raised projection of the flume.

4. A waterslide amusement ride comprising:

a. a flume having a lowermost inner surface having a lateral center;

b. the flume having a vertically raised projection from the lowermost inner surface at the lateral center;

c. a linear induction motor primary on an upper region of the raised projection;

d. the linear induction motor primary vertically above the lowermost inner surface of the flume;

e. a vehicle longitudinally traversing the flume;

f. the vehicle having a linear induction motor secondary in a laterally central region thereof;

g. the linear induction motor secondary positioned vertically above the linear induction motor primary when the vehicle is traversing above the vertically raised projection of the flume; and h. the vehicle having a vehicle sliding surface on either lateral side of the vertically raised projection when the vehicle is traversing above the vertically raised projection of the flume;

i. wherein the vertically raised projection of the flume comprises a surface defining a downward extending slot into which extends the linear induction motor secondary.

5. The waterslide amusement as recited in claim 4 wherein the linear induction motor comprises a plurality of primaries, one on each lateral inner side of the slot.

* * * * *